US011532889B2

(12) United States Patent
Hamabe

(10) Patent No.: US 11,532,889 B2
(45) Date of Patent: Dec. 20, 2022

(54) ANTENNA DEVICE

(71) Applicant: Panasonic Intellectual Property Management Co., Ltd., Osaka (JP)

(72) Inventor: Taichi Hamabe, Kanagawa (JP)

(73) Assignee: PANASONIC INTELLECTUAL PROPERTY MANAGEMENT CO., LTD, Osaka (JP)

( * ) Notice: Subject to any disclaimer, the term of this patent is extended or adjusted under 35 U.S.C. 154(b) by 154 days.

(21) Appl. No.: 16/985,325

(22) Filed: Aug. 5, 2020

(65) Prior Publication Data

US 2020/0365995 A1 Nov. 19, 2020

Related U.S. Application Data

(63) Continuation of application No. PCT/JP2019/004002, filed on Feb. 5, 2019.

(30) Foreign Application Priority Data

Feb. 5, 2018 (JP) ..... JP2018-018679

(51) Int. Cl.
*H01Q 1/38* (2006.01)
*H01Q 11/14* (2006.01)
*H01Q 9/28* (2006.01)

(52) U.S. Cl.
CPC ..... *H01Q 11/14* (2013.01); *H01Q 1/38* (2013.01); *H01Q 9/28* (2013.01)

(58) Field of Classification Search
CPC . H01Q 11/14; H01Q 1/38; H01Q 9/28; H01Q 9/045; H01Q 9/0421
See application file for complete search history.

(56) References Cited

U.S. PATENT DOCUMENTS 4,600,906 A * 7/1986 Blight ..... H01P 1/218 333/205
6,335,703 B1 1/2002 Chang et al.

FOREIGN PATENT DOCUMENTS

JP 3-148902 6/1991
JP 2004-208223 7/2004
JP 2012-249204 12/2012
(Continued)

OTHER PUBLICATIONS

Shinji Nakano et al., "Wide Band Impedance Matching of a Polarization Diversity Patch Antenna by Use of Stubs Mounted on the Patch" Nov. 2003, The Transactions of the Institute of Electronics, Information and Communication Engineers B, vol. J86-B, No. 11, pp. 2,428-2,432, with partial English translation.
(Continued)

*Primary Examiner* — Graham P Smith
(74) *Attorney, Agent, or Firm* — Wenderoth, Lind & Ponack, LLP

(57) ABSTRACT

An antenna device includes an antenna surface on which an antenna conductor is provided, a ground surface which is opposed to the antenna surface and on which a ground conductor is provided, and a stub configured by connecting, in series, a plurality of transmission lines in which a line width of at least a part of at least one transmission line is different from line widths of other two or more transmission lines. The at least one transmission line has straight portions and a bent portion.

7 Claims, 16 Drawing Sheets

(56) References Cited

FOREIGN PATENT DOCUMENTS

WO 2005/024998 3/2005

OTHER PUBLICATIONS

International Search Report dated Mar. 5, 2019 in International (PCT) Patent Application No. PCT/JP2019/004002, with English translation.
Written Opinion of the International Searching Authority dated Mar. 5, 2019 in International (PCT) Patent Application No. PCT/JP2019/004002, with English translation.

* cited by examiner

ANTENNA DEVICE

BACKGROUND OF THE INVENTION

1. Field of the Invention

The present disclosure relates to an antenna device.

2. Description of the Related Art

Non-patent document 1 discloses, as a conventional antenna device to be incorporated in a mobile communication terminal, a patch antenna that uses communication frequencies in the 2 GHz band, for example. To widen the communication frequency range, this patch antenna has a three-layer structure in which a lower layer having a ground surface, a middle layer having an antenna surface, and an upper layer having a stab provided by transmission lines are laid one on another Non-patent document 1: Shinji Nakano and other four persons, "Wide Band Impedance Matching of a Polarization Diversity Patch Antenna by Use of Stubs Mounted on the Patch" November 2003, The Transactions of the Institute of Electronics, Information and Communication Engineers B, Vol. J86-B, No. 11, pp. 2,428-2,432.

SUMMARY OF THE INVENTION

The concept of the present disclosure has been conceived in the above-described circumstances in the art, and an object of the disclosure is therefore to provide an antenna device capable of widening the communication frequency band and increasing the antenna gain by decreasing the Q value indicating the sharpness of a peak of a resonance frequency characteristic without increasing the overall thickness of the antenna device itself.

The present disclosure provides an antenna device including an antenna surface on which an antenna conductor is provided; a ground surface which is opposed to the antenna surface and on which a ground conductor is provided; and a stub configured by connecting, in series, a plurality of transmission lines in which a line width of at least a part of at least one transmission line is different from other two or more transmission lines. The at least one transmission line has straight portions and a bent portion.

The disclosure makes it possible to widen the communication frequency band and increase the antenna gain by decreasing the Q value indicating the sharpness of a peak of a resonance frequency characteristic without increasing the overall thickness of the antenna device itself.

DETAILED DESCRIPTION OF THE EXEMPLARY EMBODIMENTS

Background Leading to Embodiments

Figure 1:
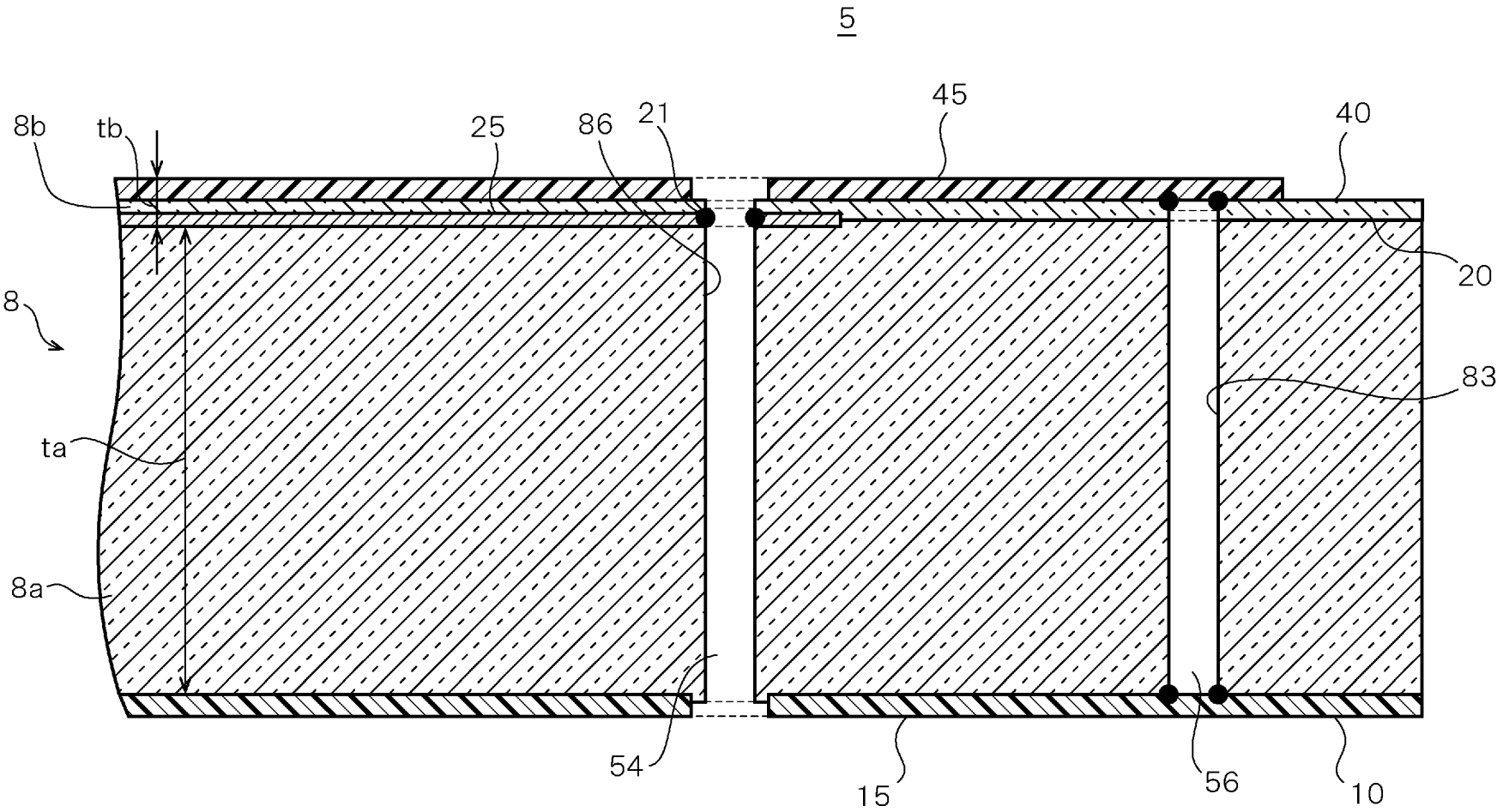
FIG. 1 is a sectional view showing a layered structure of a patch antenna according to a first embodiment.

In Non-patent document 1, the antenna surface has a copper foil patch provided on a surface of a dielectric. The patch forms a parallel resonance circuit that radiates radio waves. The ground surface has a ground conductor that is shaped from a metal plate into a shape that extends parallel with a body of a mobile communication terminal. The stub has transmission lines provided on a surface of the dielectric and forms a series resonance circuit. Coupled with the patch in series, the stub can make the reactance component of the patch antenna close to zero and thereby widen the communication frequency range of the antenna device.

However, in the antenna device disclosed in Non-patent document 1, the antenna surface is interposed between the ground surface and the stub. This means a structure that the interval between the antenna surface and the ground surface is small and hence the Q value indicating the sharpness of a peak of a resonance frequency characteristic is increased, resulting in a problem that further bandwidth widening is difficult. On the other hand, the overall thickness of the antenna device itself is restricted to miniaturize the antenna device. As a result, in the configuration of the antenna device of Non-patent document 1, the interval between the antenna surface and the ground surface cannot be increased. In other words, it is difficult to reduce the Q value of the patch antenna, which makes it difficult to further widen the communication frequency range or increase the antenna gain.

In view of the above, an example antenna device capable of widening the communication frequency range and increasing the antenna gain by decreasing the Q value indicating the sharpness of a peak of a resonance frequency characteristic without increasing the overall thickness of the antenna device itself will be described in each of the following embodiments.

Each embodiment as a specific disclosure of an antenna device according to the present disclosure will be described in detail by referring to the drawings when necessary. However, unnecessarily detailed descriptions may be avoided. For example, detailed descriptions of already well-known items and duplicated descriptions of constituent elements having substantially the same ones already described may be omitted. This is to prevent the following description from becoming unnecessarily redundant and thereby facilitate understanding of those skilled in the art. The following description and the accompanying drawings are provided to allow those skilled in the art to understand the disclosure thoroughly and are not intended to restrict the subject matter set forth in the claims.

An antenna device according to each of the following embodiments will be described for an example use that it is applied to a patch antenna (i.e., microstrip antenna) that is incorporated in a seat monitor installed on the back side of a seat of an airplane, for example. However, the device that is provided with the antenna device (patch antenna) is not limited to a seat monitor as mentioned above.

Embodiment 1

FIG. 1 is a sectional view showing a layered structure of a patch antenna 5 according to a first embodiment. FIG. 1 is a sectional view taken along an arrowed line E-E in FIG. 2 and an arrowed line F-F in FIG. 4. The patch antenna 5 has a substrate 8 having a three-layer structure in which a ground surface 10, a power supply surface 20, and an antenna surface 40 are provided in a lower layer, a middle layer, and an upper layer, respectively, which are laid one on another. The patch antenna 5 according to the first embodiment transmits a radio signal (in other words, radio waves) in, for example, the 2.4 GHz frequency band as an operative frequency band.

The substrate 8 is a dielectric substrate obtained by shaping a dielectric material having large relative permittivity such as PPO (polyphenylene oxide) and has a structure that a first substrate 8*a* and a second substrate 8*b* are laid on each other. In the sectional view of FIG. 1, the front side and the back side are the top side and the bottom side, respectively, in the paper surface of FIG. 1. The ground surface 10 is in the back surface of the first substrate 8*a*. The antenna surface 40 is in the front surface of the second substrate 8*b*. The power supply surface 20 is provided between the front surface of the first substrate 8*a* and the back surface of the second substrate 8*b*. Thus, in the patch antenna 5 according to the first embodiment, the antenna surface 40 is supplied with power from the power supply surface 20 by bottom surface energization. The total thickness of the substrate 8 is 2.6 mm, for example. For details, the thickness to of the first substrate 8*a* is 2.4 mm. The thickness tb of the second substrate 8*b* is 0.1 mm. The thickness of a copper foil is 0.1 mm. A wireless communication circuit (not shown) for supplying power to the patch antenna 5 is provided on the back side surface of the substrate 8 (i.e., on the back surface of the ground surface 10).

Via conductors 54 and 56 are provided in respective through-holes 86 and 83 which penetrate through the substrate 8 from its front surface (i.e., antenna surface 40) to its back surface (i.e., ground surface 10). The via conductors 54 and 56 are formed in cylindrical shape by charging a conductive material into the through-holes 86 and 83. The via conductor 54 is a single conductor that is electrically connected to a power supply point 21 (i.e., an intermediate cross section of the via conductor 54) provided on the power supply surface 20. The via conductor 54 is a power supply conductor for driving the antenna surface 40 so that it serves as a patch antenna. It is noted that in FIG. 1, black circles shown at the connection point between the via conductor 54 and the power supply surface 20, black circles shown at the connection point between the via conductor 54 and the antenna surface 40, and black circles shown at the connection point between the via conductor 54 and the ground surface 10 indicate that electrical continuity is established there.

Figure 2:
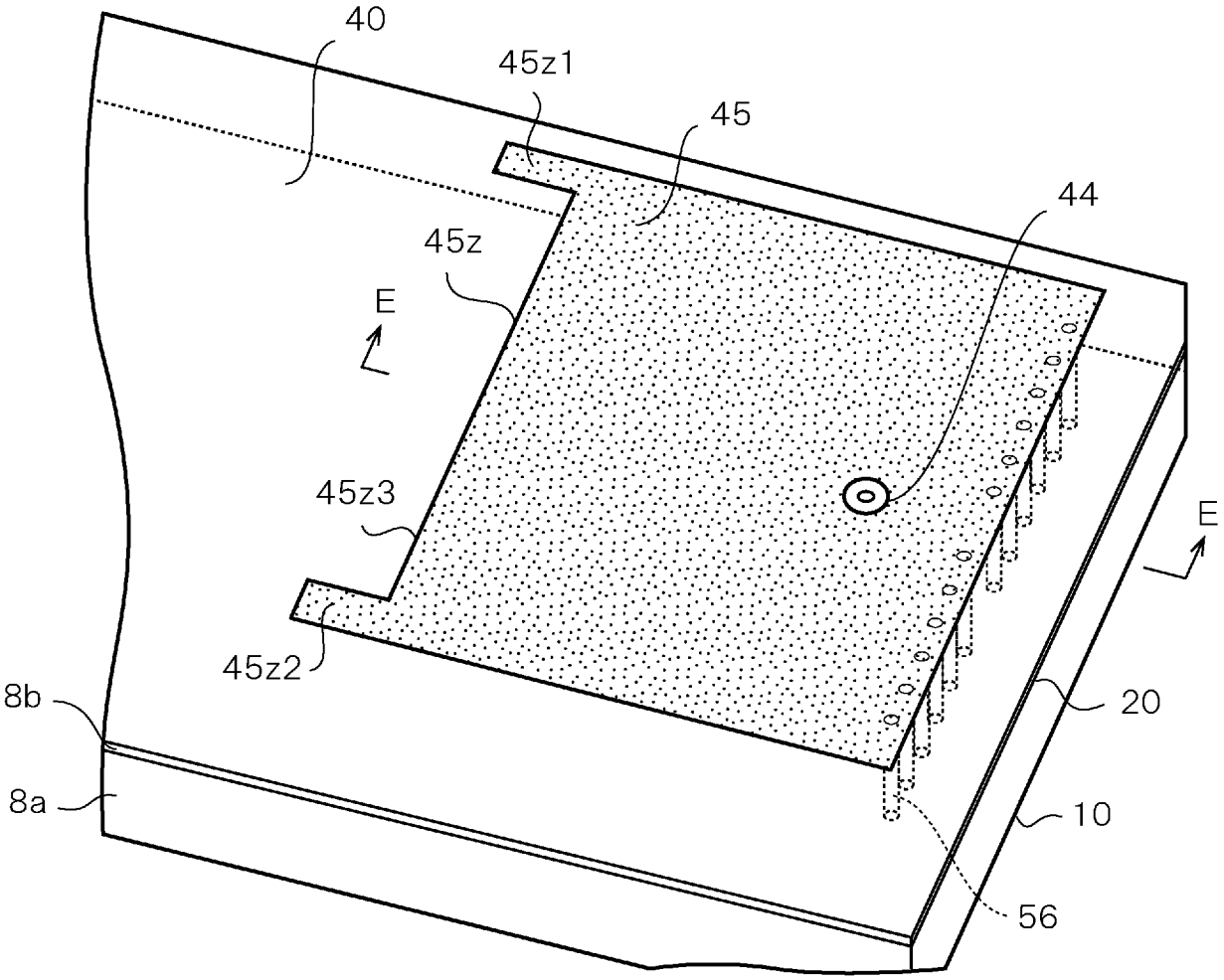
FIG. 2 is a perspective view showing an antenna surface.

The via conductors 56 are a plurality of conductors for electrically connecting a patch 45 (an example of a term "antenna conductor") provided on the antenna surface 40 to a ground conductor 15 provided on the ground surface 10 (see FIG. 2). The via conductors 56 are not electrically connected to anything existing in or on the power supply surface 20 and are merely inserted through the power supply surface 20. A plurality of through-holes 83 penetrate through the power supply surface 20.

Figure 3:
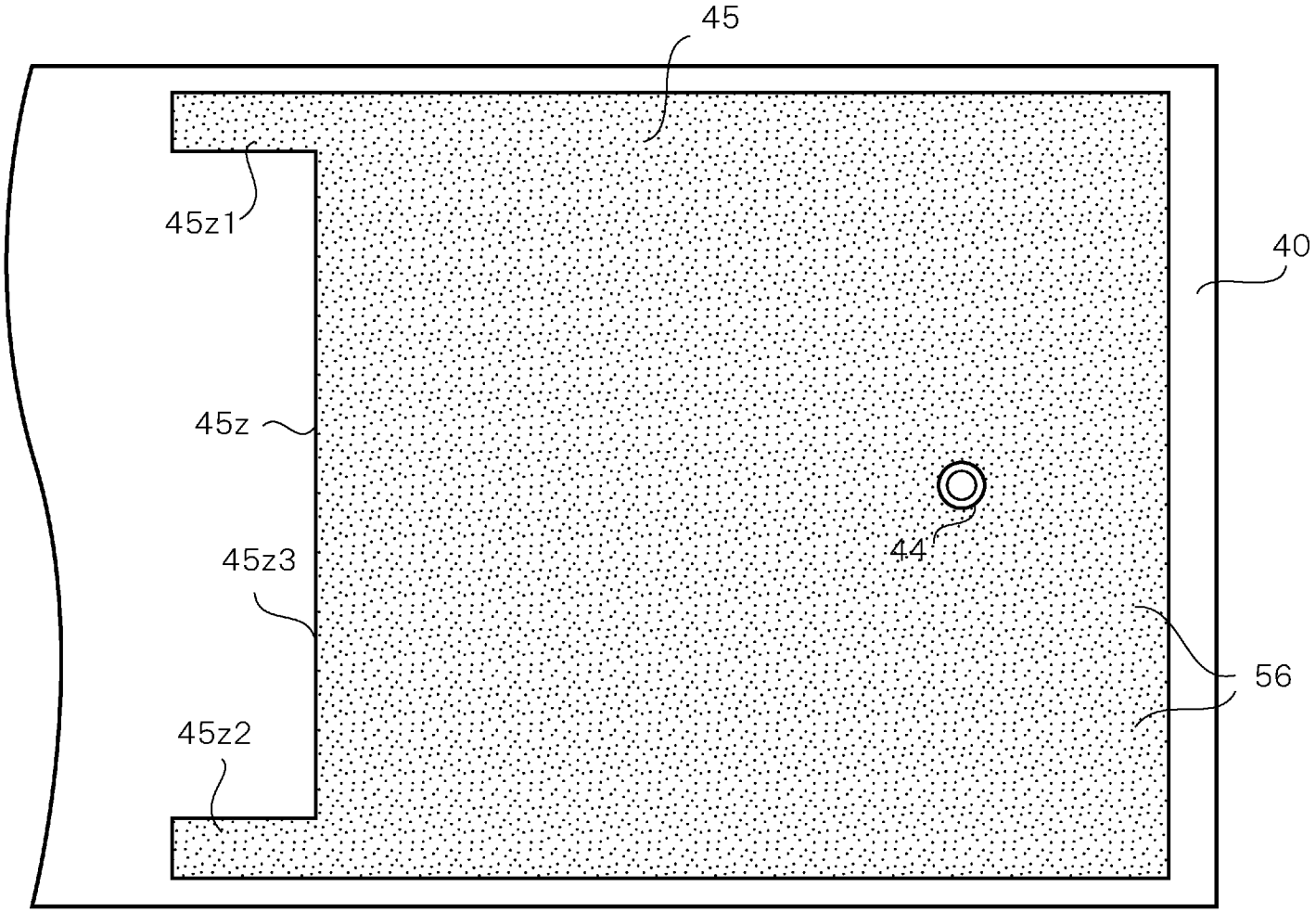
FIG. 3 is a plan view showing the antenna surface.

FIG. 2 is a perspective view showing the antenna surface 40. FIG. 3 is a plan view showing the antenna surface 40. The patch 45, which is an example of an antenna conductor for the 2.4-GHz band, is provided on the antenna surface 40. The patch 45 is made of copper foil and has an approximately rectangular outline. An opening 44 is formed at one position in the planar patch 45 so as to have a diameter that is larger than the diameter of the through-hole 86 (in other words, via conductor 54). The patch 45, which has a characteristic of a parallel resonance circuit, radiates a radio signal (i.e., radio waves) according to an excitation signal that is supplied from the wireless communication circuit (not shown) to the power supply point 21 of a stub 25. The center frequency of the resonance frequency range of the patch 45 is determined by its length in the width direction. One end portion (an end portion that is close to the center of the substrate 8) of the patch 45 having an approximately rectangular outline, that is, one side that is most distant from a corresponding point that is a point in the patch 45 obtained by moving the power supply point 21 upward imaginarily (in other words, an imaginary corresponding point in the patch 45), is formed with a cut 45*z*. The cut 45*z* is formed in a concave shape by a pair of projections 45*z*1 and 45*z*2 which project on the surface of the substrate 8 and a recess bottom 45*z*3 provided between the pair of projections 45*z*1 and 45*z*2. Although in the embodiment the two projections are provided so as to be left-right symmetrical with each other, they may be not symmetrical and only one projection may be formed. As a further alternative, projections may be provided at positions other than the ends.

In patch antennas, to facilitate resonance, it is preferable that the length of the entire circumference of the patch be set so as to be shorter than that of a ground conductor provided on the ground surface by one to two wavelengths. Setting the entire circumference of the patch long decreases the Q value indicating the sharpness of a resonance frequency characteristic and thereby facilitates impedance matching. Thus, the resonance frequency bandwidth is increased. On the other hand, increasing the patch area leads to increase of the Q value.

In view of the above, in the first embodiment, the one end portion of the patch 45 is formed with a cut 45*z* to increase the length of the entire circumference of the patch without increasing its area. This decreases the Q value and increases the bandwidth.

The length of the entire circumference and the area of the patch 45 can be changed by changing the cutting depth of the cut 45*z*. For example, if the cutting depth is increased (i.e., the pair of projections 45z1 and 45z2 are made longer so that the recess bottom 45z3 is located at a deeper position and comes closer to the opening 44 side), the entire circumference of the patch 45 is made longer the cut 45z and the area of the patch 45 is made smaller than with the cut 45z shown. As a result, the Q value is decreased and the bandwidth is increased further. On the other hand, if the cutting depth is decreased (i.e., the pair of projections 45z1 and 45z2 are made shorter so that the recess bottom 45z3 is located at a shallower position and goes away from the opening 44 side), the entire circumference of the patch 45 is made shorter and the area of the patch 45 is made larger than with the cut 45z shown. As a result, the Q value is increased and the bandwidth is narrowed.

As described above, the Q value, that is, the bandwidth, of radio waves transmitted from the patch 45 can be adjusted by changing the cutting depth of the cut 45z. Furthermore, the center frequency of the resonance frequency range can be changed by changing the length of the entire circumference of the patch. Furthermore, the depth of the cut can be adjusted easily because the antenna surface on which the patch is provided is formed in the upper layer of the substrate.

Figure 4:
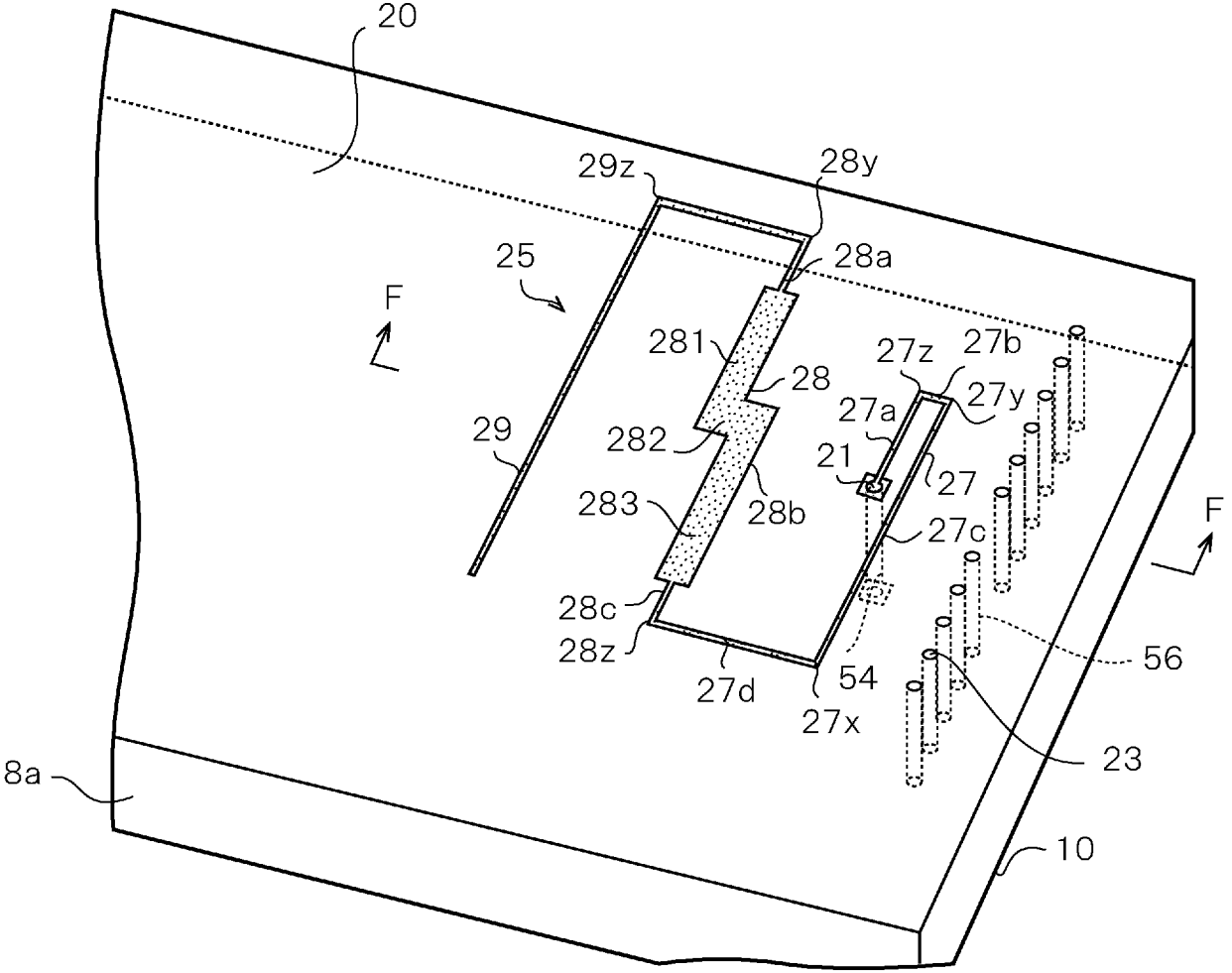
FIG. 4 is a perspective view showing a power supply surface.
Figure 5:
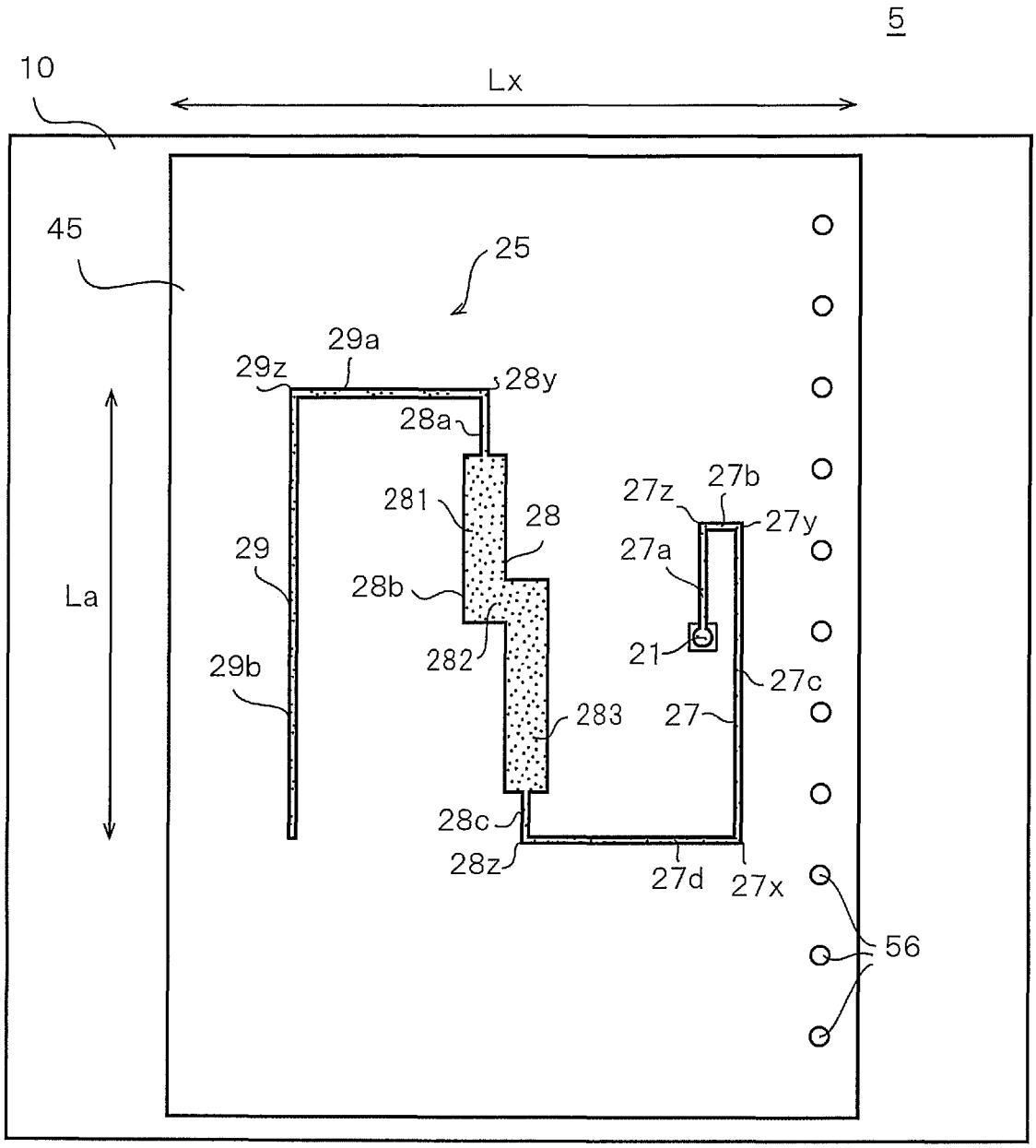
FIG. 5 is a plan view showing the power supply surface.

FIG. 4 is a perspective view showing the power supply surface 20. FIG. 5 is a plan view showing the power supply surface 20. The stub 25 (an example of a term "power supply line") is provided in the power supply surface 20. The stub 25 has a characteristic of a series resonance circuit that is connected to the patch 45 in series to take impedance matching of the patch antenna 5 that is suitable for an operation target frequency band. That is, the stub 25 can make the radiation reactance component of the patch antenna 5 close to zero by coupling with the patch 45 in series electrically.

The stub 25 has a shape that the power supply point 21, a first transmission line 27, a second transmission line 28, a third transmission line 29 are connected to each other in series. The lengths of the first transmission line 27, the second transmission line 28, and the third transmission line 29 are the same and equal to $\lambda/4$ ($\lambda$: a wavelength corresponding to a resonance frequency) and the overall length of the stub 25 is equal to $3\lambda/4$. The lengths (line lengths) of the first transmission line 27, the second transmission line 28, and the third transmission line 29 need not always be the same.

The first transmission line 27 has four lines 27a, 27b, 27c, and 27d, and starts from the power supply point 21 and are then bent (approximately) perpendicularly at three bending portions 27z, 27y, and 27x. The four lines 27a-27d have the same line width. The first transmission line 27 may further have a line 28c which is bent at a bending portion 28z (described later) (approximately) perpendicularly (the first transmission line 27 is bent there in addition to at the three bending portions 27z, 27y, and 27x). The line 28c has the same line width as each of the four lines 27a-27d.

The second transmission line 28 has three lines 28a, 28b, and 28c and is bent (approximately) perpendicularly at two bending portions 28z and 28y. The second transmission line 28 includes a line 28b which is larger in line width than the first transmission line 27 and the third transmission line 29. The two lines 28a and 28c and the four lines 27a-27d have the same line width. The second transmission line 28 may be provided so as to have only the line 28b which is larger in line width than the lines 28a and 28c.

The line 28b which is large in line width includes a first straight portion 281, a bent portion 282, and a second straight portion 283 which are continuous with each other. For example, the first straight portion 281, the bent portion 282, and the second straight portion 283 are formed so as to have the same width. Since the first straight portion 281 and the second straight portion 283 are formed so as to be deviated from each other by their width and connected to each other by the bent portion 282, the area in its width direction of the bent portion 282 is wider than that of the first straight portion 281 and that of the second straight portion 283. The center of gravity of the line 28b which is large in line width is located in the vicinity of the bent portion 282 and is made closer to the power supply point 21. Since the center of gravity of the line 28b is made closer to the power supply point 21 and the area of the line 28b is concentrated in the vicinity of the bent portion 282, the degree of electrical coupling between the line 28b and the power supply point 21 can be made higher without the need for changing the length of the line 28b. This makes it easier to make the radiation reactance component of the patch antenna 5 close to zero and to thereby increase the gain. Furthermore, in the line 28b which is large in line width, since the bent portion 282 is formed at a halfway position in the line 28b, the length La of the line 28b in its longitudinal direction can be made shorter than in a case that the line 28b is formed straightly even if its area is kept the same. This makes it possible to suppress the width of the substrate and thereby miniaturize the patch antenna.

The shape of the line 28b which is large in line width is not limited to the one shown in FIGS. 4 and 5. Although in FIGS. 4 and 5 the bent portion 282 is formed (bent) so as to come closer to the power supply point 21 as the position goes from the first straight portion 281 to the second straight portion 283, the bent portion 282, the bent portion 282 may be formed (bent) so as to go away from the power supply point 21. That is, the bent portion 282 may be formed (bent) so as to have either of portions that are symmetrical with respect to the longitudinal direction of the first straight portion 281. In FIGS. 4 and 5, the length of the bent portion 282 is equal to the sum of the widths of the first straight portion 281 and the second straight portion 283 (i.e., two times the width of each of them). Alternatively, the length of the bent portion 282 may be set longer than two times the width of each of the first straight portion 281 and the second straight portion 283 so that the bent portion 282 becomes a straight portion extending perpendicularly to them. This makes it possible to increase or decrease the area of the bent portion 282 and to concentrate the area of the line 28b around its center of gravity.

Figure 16:
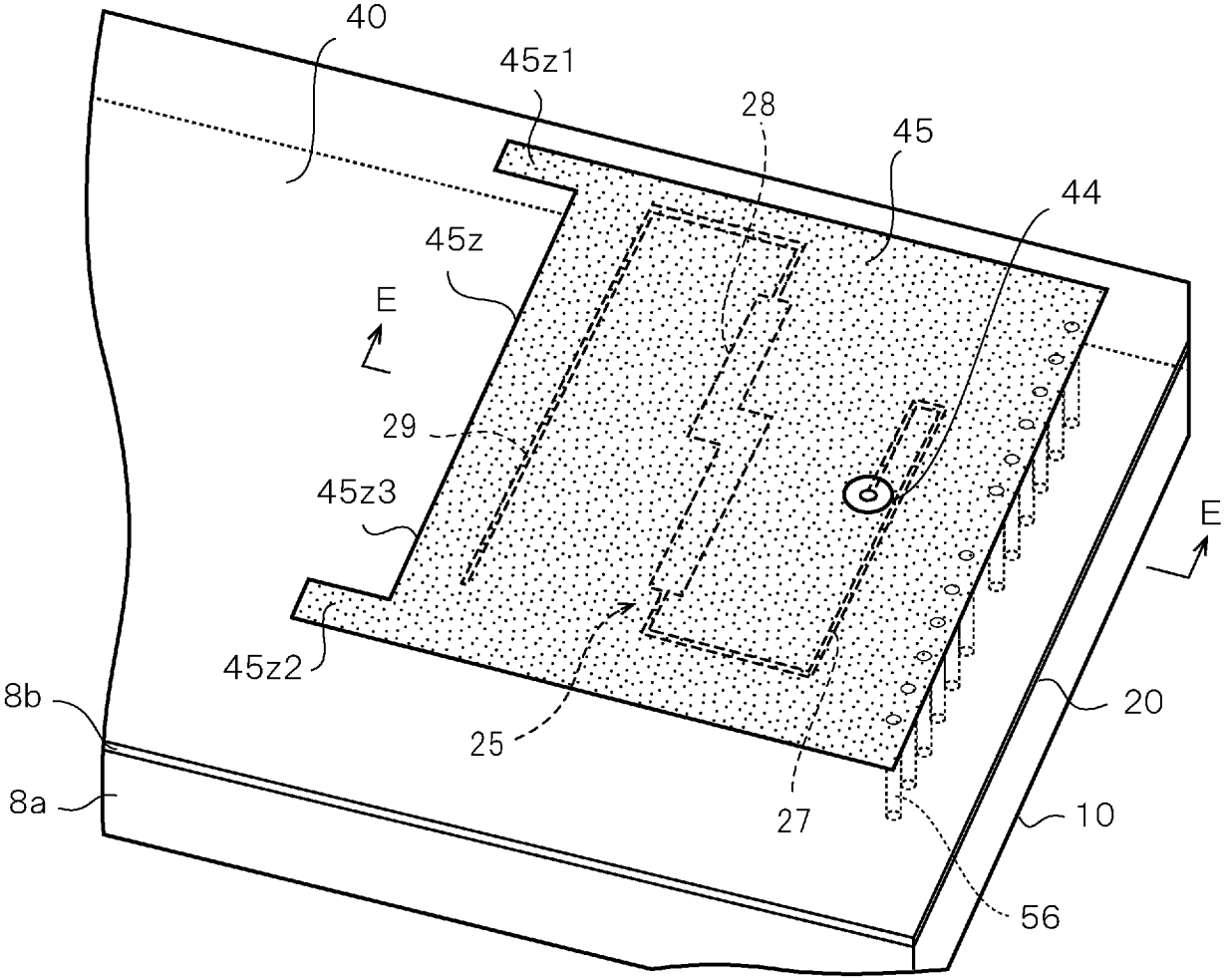
FIG. 16 is a perspective view showing an example positional relationship between a cut formed in a patch and a stub provided on the power supply surface.

The third transmission line 29 has two lines 29a and 29b, and are bent (approximately) perpendicularly at one bending portion 29z and terminates at an end point. The two lines 29a and 29b have the same line width. The antenna gain and the bandwidth are increased, that is, the VSWR comes closer to 1, as the third transmission line 29 is brought closer to the cut 45z (see FIG. 16). FIG. 16 is a perspective view showing an example positional relationship between the cut 45z formed in the patch 45 and the stub 25 provided in the power supply surface 20. In FIG. 16, the stub 25 is drawn by a broken line because it is formed in the power supply surface 20 which is formed in a lower layer than the antenna surface 40 is. No detailed description will be made here with reference to FIG. 16 because the stub 25 has already been described above in detail.

The length in the left-right direction of FIG. 2 on the antenna surface 40 is determined depending on an operation frequency that the patch antenna 5 can accommodate. Likewise, the length of the stub 25 in the left-right direction of FIG. 2 in the power supply surface 20 is determined depending on the operation frequency that the patch antenna 5 can accommodate. Thus, where the stub 25 is disposed so that its third transmission line 29 is set closer to the end of the antenna surface 40 (for example, the left end in the left-right direction in the paper surface of FIG. 2) without changing the length on the antenna surface 40 in the left-right direction in the paper surface of FIG. 2, the degree of electrical coupling between the antenna surface 40 (more specifically, patch 45) and the power supply surface 20 (more specifically, stub 25) and the gain of the patch antenna 5 can be increased and the bandwidth can be increased. To this end, forming the cut 45*z* in the patch 45 as shown in FIG. 16 is effective in increasing the degree of electrical coupling between the stub 25 including the third transmission line 29 and the patch 45 and thereby improving the characteristics of the patch antenna 5.

Although in the above description the second transmission line 28 has the bend portion, the first transmission line 27 and the third transmission line 29 may have a bent portion. Furthermore, the stub 25 may be disposed so as to be rotated by 90° from the state shown in FIG. 4; the rotation angle may be any angle.

The first transmission line 27 may further have the line 28*a* including the bent portion 28*z* in addition to the four lines 27*a*-27*d*. Likewise, the third transmission line 29 may further have the line 28*c* including the bent portion 28*y* in addition to the two lines 29*a* and 29*b*. In this case, the stub 25 is formed by three transmission lines whose line widths are different from each other and that have the same line length. Their line lengths need not always be the same.

Figure 6:
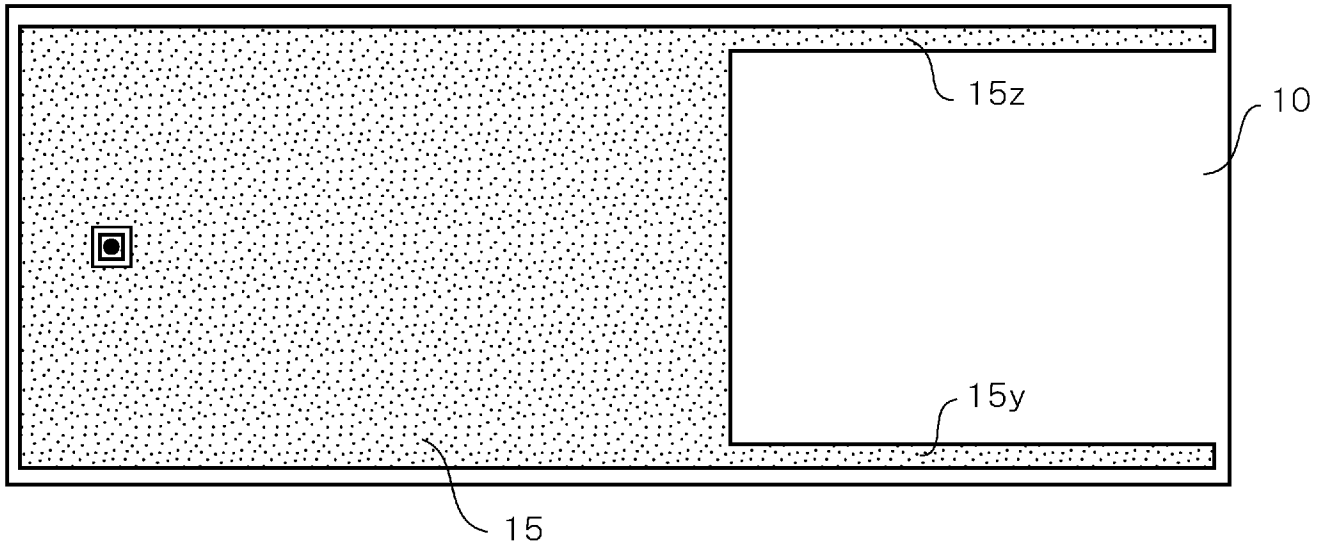
FIG. 6 is a plan view showing a ground surface.

FIG. 6 is a plan view showing the ground surface 10. The ground conductor 15 provided on the ground surface 10 is made of copper foil and is approximately shaped like a rectangle so as to cover almost the entire back surface of the substrate 8. A pair of extension portions 15*z* and 15*y* having a prescribed length project, so as to be opposed to each other, from the two respective ends of the side, far from a corresponding point on the ground surface 10 (in other words, an imaginary corresponding point on the ground surface 10) obtained by moving the power supply point 21 downward imaginarily, of the ground conductor 15. Each of the pair of extension portions 15*z* and 15*y* is shaped like a narrow rectangle. Because of the pair of extension portions 15*z* and 15*y*, the length of the overall circumference of the ground conductor 15 which is approximately shaped like a rectangle is increased by about two times the longitudinal length of the extension portions 15*z* and 15*y*. That is, four times the length of the extension portions 15*z* and 15*y* contributes to the length of the overall circumference of the ground conductor 15. Since the extension portions 15*z* and 15*y* are narrow, the formation of the pair of extension portions 15*z* and 15*y* increases the area of the ground conductor 15 only a little. Forming the pair of extension portions 15*z* and 15*y* adjoining the side that is far from the above-mentioned imaginary corresponding point on the ground surface 10 can increase the length of the overall circumference of the ground conductor 15 without increasing its area. Although in the first embodiment the pair of extension portions 15*z* and 15*y* have the same length, they may be different from each other in length. In this case, the lengths of the extension portions 15*z* and 15*y* can be determined according to a substrate shape, that is, the degree of freedom of the shape of the ground conductor 15 is increased.

It becomes easier to cause resonance when the overall circumference of the ground conductor 15 is made longer. That is, the length of the overall circumference of the patch 45 which is set shorter than the length of the overall circumference of the ground conductor 15 by one to two wavelengths can be increased according to the latter. This makes it easier to take impedance matching, decreases the Q value, and increase the bandwidth. The width Lx of the patch 45 can be adjusted more easily by changing the length of the overall circumference of the ground conductor 15 which is provided on the ground surface 10. This facilitates adjustment of the center frequency of the resonance frequency range.

Next, the performance of the patch antenna 5 according to the first embodiment will be described.

Figure 7:
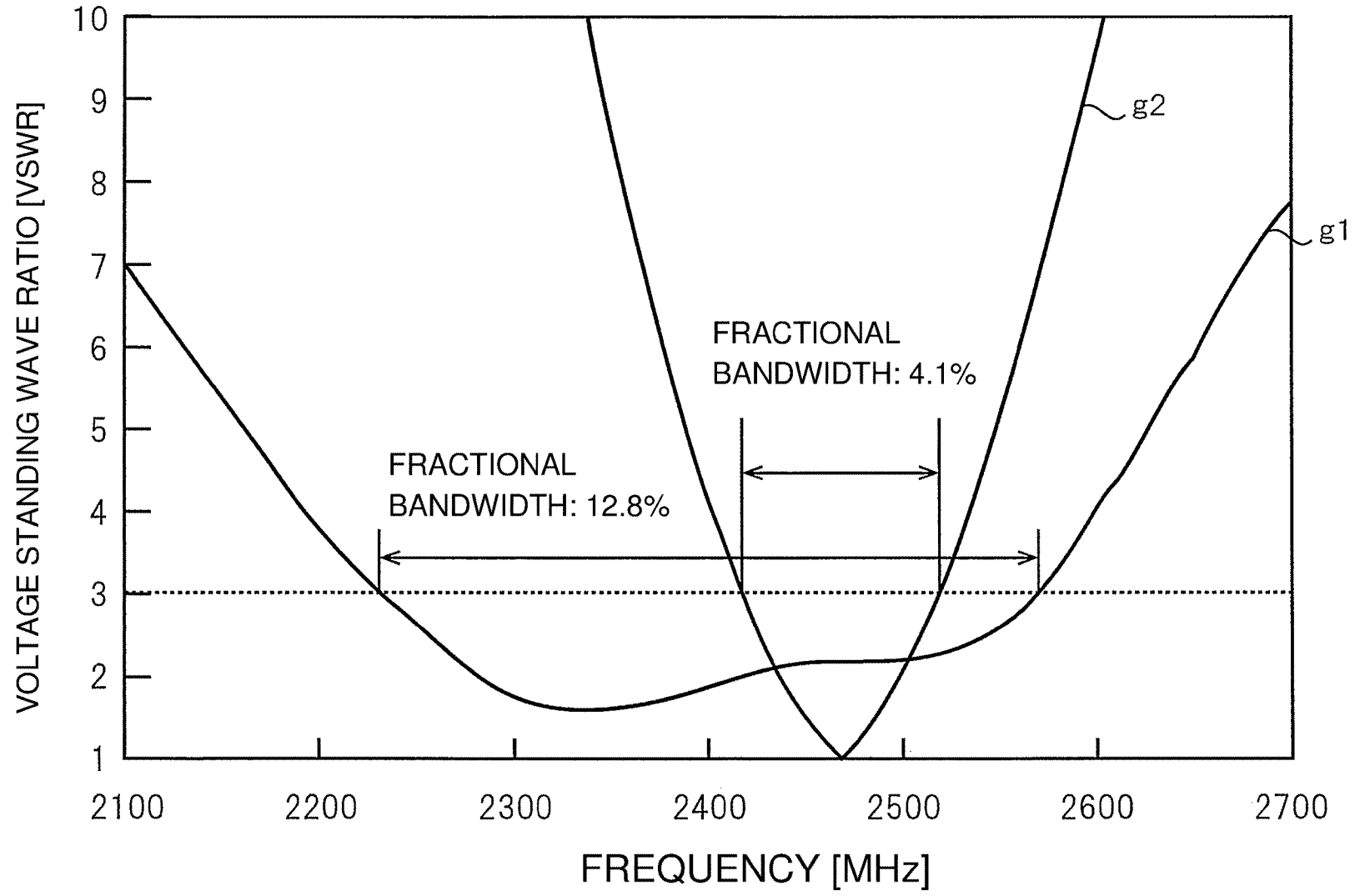
FIG. 7 is a graph showing a voltage standing wave ratio characteristic of the patch antenna.

FIG. 7 is a graph showing a voltage standing wave ratio (VSWR) characteristic of the patch antenna 5. The vertical axis represents the VSWR and the horizontal axis represents the frequency. The voltage standing wave ratio is the ratio between a traveling wave and a reflection wave of a standing wave and indicates the degree of impedance matching (the degree of reflection). In particular, the voltage standing wave ratio is calculated as a ratio between a voltage maximum amplitude and a voltage minimum amplitude of a radio wave that is a standing wave. As the VSWR value comes closer to a value "1," the reflection wave becomes weaker and the degree of impedance matching becomes higher. Thus, the radio wave transmission efficiency is higher when the VSWR is closer to the value "1." In the first embodiment, a frequency range in which the VSWR is smaller than or equal to 3.0 is used for determining a fractional bandwidth and whether the bandwidth is wide or narrow is judged by its fractional bandwidth. The fractional bandwidth is calculated by dividing the bandwidth where the VSWR is smaller than or equal to 3.0 by the center frequency and is represented by Equation (1) described below. In Equation (1), fH and fL are the maximum frequency and the minimum frequency, respectively, of a bandwidth where the VSWR is smaller than or equal to 3.0.

(Equation 1)

$$\text{(Fractional bandwidth((bandwidth)/(center frequency))}=(fH-fL)/\{(fH+fL)/2\} \quad (1)$$

FIG. 7 shows fractional bandwidths in a frequency range in the vicinity of 2.4 MHz. Graph g1 represents a VSWR characteristic of the patch antenna 5. The VSWR of the patch antenna 5 has a very gentle peak for a frequency variation. In particular, a frequency range in which the VSWR is smaller than or equal to 3.0 is a wide range of 2,240 MHz to 2,560 MHz. Thus, the fractional bandwidth is equal to 12.8%. It is considered that the cut 45*z* formed in the patch 45 has a great contribution to the fact that the bandwidth of the patch antenna 5 is wide.

On the other hand, graph g2 represents a VSWR characteristic of a conventional patch antenna. For example, the conventional patch antenna is a patch antenna in which the patch is not formed with a cut. The VSWR of the conventional patch antenna has a relatively steep peak around 2,460 MHz. A frequency range in which the VSWR is smaller than or equal to 3.0 is a narrow range of 2,420 MHz to 2,520 MHz. Thus, the fractional bandwidth is equal to 4.1%. Incidentally, other than the patch antenna in which the patch is not formed with a cut, the conventional patch antenna may be a patch antenna in which the stub line has no bent portion or a patch antenna in which the ground conductor is not formed with a pair of extension portions.

As described above, the patch antenna 5 according to the first embodiment has a wide bandwidth characteristic. By virtue of the increase of the bandwidth, the patch antenna 5 is high in the transmission efficiency of radio waves and large in gain.

Figure 8A:
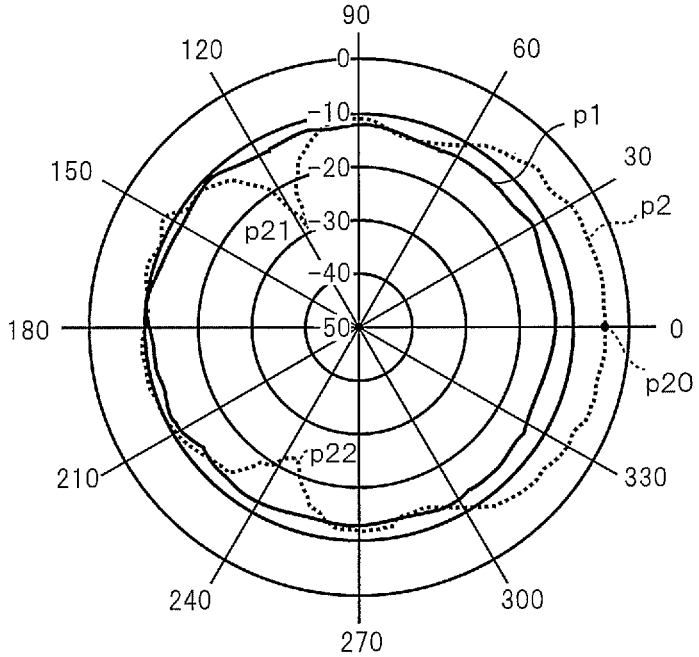
FIG. 8A is a directivity characteristic diagram showing radiation patterns of vertically polarized radio waves.

FIG. 8A is a directivity characteristic diagram showing radiation patterns of vertically polarized radio waves. In the patch antenna 5, an approximately uniform radiation gain can be obtained in a radiation pattern p1 of vertically polarized radio waves. That is, the radiation gain is approximately the same, that is, within a range of −10 dB to −15 dB, in the vertical plane when the radiation direction of vertically polarized radio waves varies from an angle 0° that is the forward direction perpendicular to the patch surface, past an angle 90° that is the upward direction parallel with the patch surface, an angle 180° that is the rearward direction perpendicular to the patch surface, and an angle 270° that is the downward direction parallel with the patch surface, to an angle 360° that is the forward direction perpendicular to the patch surface. Thus, vertically polarized radio waves radiated from the patch antenna 5 is non-directional, that is, approximately uniform in intensity.

On the other hand, in a conventional patch antenna, a radiation pattern p2 of vertically polarized radio waves has a peak p20 (gain: −4.2 dBi) at an angle 0° that is the forward direction of the patch antenna. Nodes p21 and p22 occur at two respective angles 120° and 240° around which the gain decreases steeply (what is called states that the electric field intensity is low). Thus, vertically polarized radio waves radiated from the conventional patch antenna are particularly weak in the directions of the angles 120° and 240° and has strong forward directivity. This conventional patch antenna is like the conventional patch antenna shown in FIG. 7.

Figure 8B:
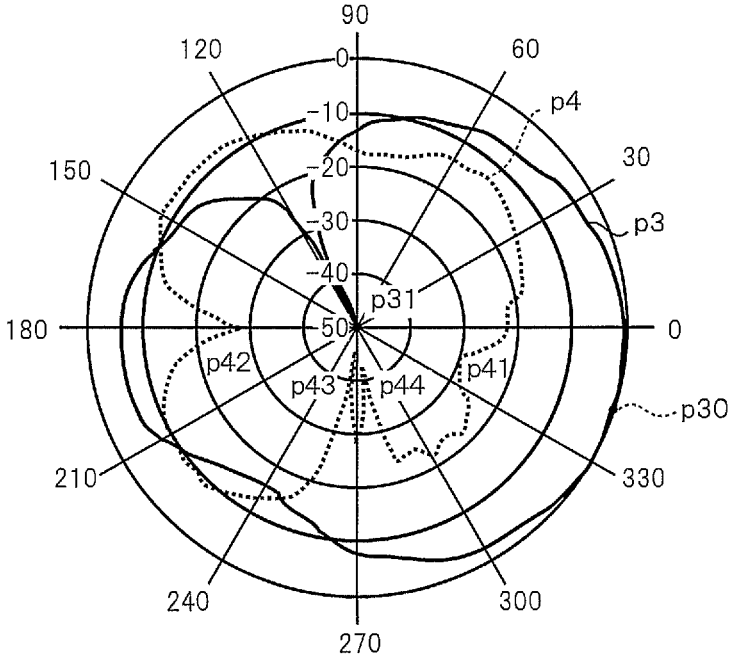
FIG. 8B is a directivity characteristic diagram showing radiation patterns of horizontally polarized radio waves.

FIG. 8B is a directivity characteristic diagram showing radiation patterns of horizontally polarized radio waves. In a radiation pattern p3 of horizontally polarized radio waves radiated from the patch antenna 5, when the radiation direction of horizontally polarized radio waves is in the neighborhood of the forward direction that is perpendicular to the patch surface, horizontally polarized radio waves radiated from the patch antenna 5 are approximately uniform in intensity. In particular, a peak p30 having a gain −0.6 dBi occurs at an angle 340°. When the radiation direction of horizontally polarized radio waves is in the neighborhood of the rearward direction that is perpendicular to the patch surface, horizontally polarized radio waves radiated from the patch antenna 5 are a little weak. In particular, a node p31 occurs at an angle 120° with respect to the patch surface around which the gain decreases steeply.

On the other hand, in the conventional patch antenna, in a radiation pattern p4 of horizontally polarized radio waves radiated from the conventional patch antenna has nodes p41, p42, p43, and p44 at a plurality of respective angles 340°, 180°, 260°, and 280° around which the electric field intensity is low. Furthermore, the gain of radio waves is small and varies in the neighborhood of the forward direction. As such, horizontally polarized radio waves radiated from the conventional patch antenna are low in gain at the plurality of nodes and are weak in the neighborhood of the forward direction.

As described above, the patch antenna 5 radiates vertically polarized radio waves and horizontally polarized radio waves in the forward direction perpendicular to the patch surface as radio waves that are approximately uniform and have large gains. Thus, where the patch antenna 5 is incorporated in a seat monitor, radio waves can propagate toward the front side of the seat monitor (i.e., forward) efficiently.

Figure 9A:
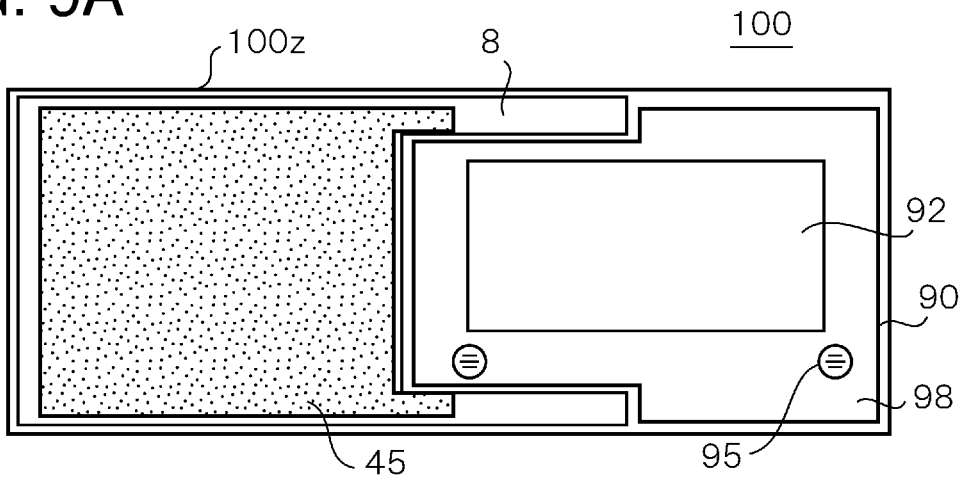
FIG. 9A is a diagram showing an inside layout of a seat monitor incorporating the patch antenna.

FIG. 9A is a diagram showing an inside layout of a seat monitor 100 incorporating the patch antenna 5. The seat monitor 100 is installed on the back side of each seat of an airplane, for example, and provides pieces of work for entertainment such as videos and musical pieces for a viewer/listener in such a manner that they are viewable/listenable. The seat monitor 100 has a body 100*z* that is shaped into a rectangular plate form. The body 100*z* houses the substrate 8 of the patch antenna 5 and a board 98 which is mounted with an output device 90 including a display unit 92 and speakers 95. The board 98 is disposed in such a manner that part of it goes into the inside of the pair of extension portions 15*z* and 15*y* of the ground conductor 15. Thus, the substrate 8 of the patch antenna 5 and the board 98 for the output device 90 can be arranged densely inside the body 100*z*, whereby the seat monitor 100 can be minimized.

The seat monitor 100 is connected, in a communicable manner, to a data server (not shown) capable of providing distribution data of videos, musical pieces, etc. The seat monitor 100 requests distribution data by transmitting a wireless signal to the data server from the patch antenna 5. The seat monitor 100 receives distribution data transmitted from the data server by the patch antenna 5, and displays a video on the display unit 92 and outputs a sound from the speakers 95 on the basis of the received distribution data.

Figure 10A:
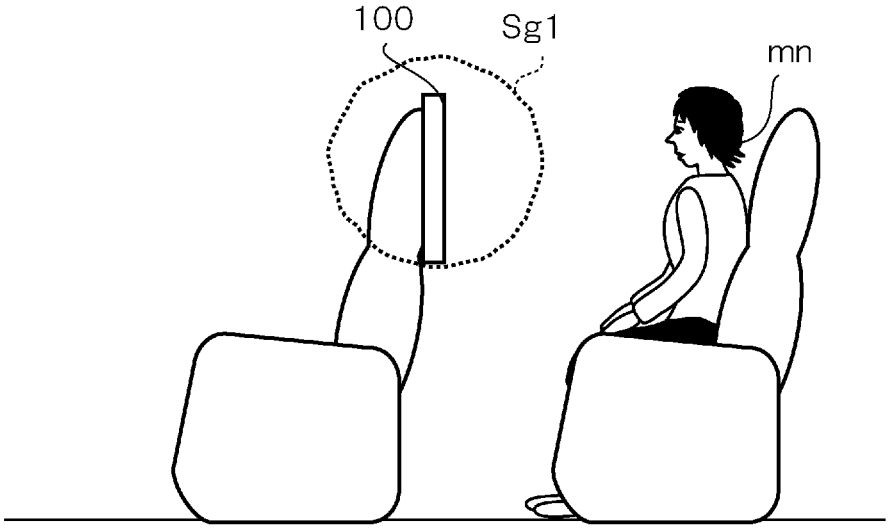
FIG. 10A is a diagram showing a radiation pattern of the patch antenna according to the first embodiment in the case where it is incorporated in the seat monitor.

FIG. 10A is a diagram showing a radiation pattern of the patch antenna 5 in the case where it is incorporated in the seat monitor 100. The patch antenna 5 is disposed in such a manner that the patch surface is parallel with the front surface of the seat monitor 100. Thus, a wireless signal Sg1 is radiated from the front surface of the seat monitor 100 toward a viewer/listener mn efficiently. Transmission and reception of distribution data are done smoothly between the seat monitor 100 and the data server.

On the other hand, in the conventional patch antenna, whereas vertically polarized radio waves can propagate forward from the patch surface, horizontally polarized radio waves are prone to propagate forward from the patch surface. Thus, radio waves cannot be radiated efficiently toward the front side (forward) from the seat monitor 100.

Figure 10B:
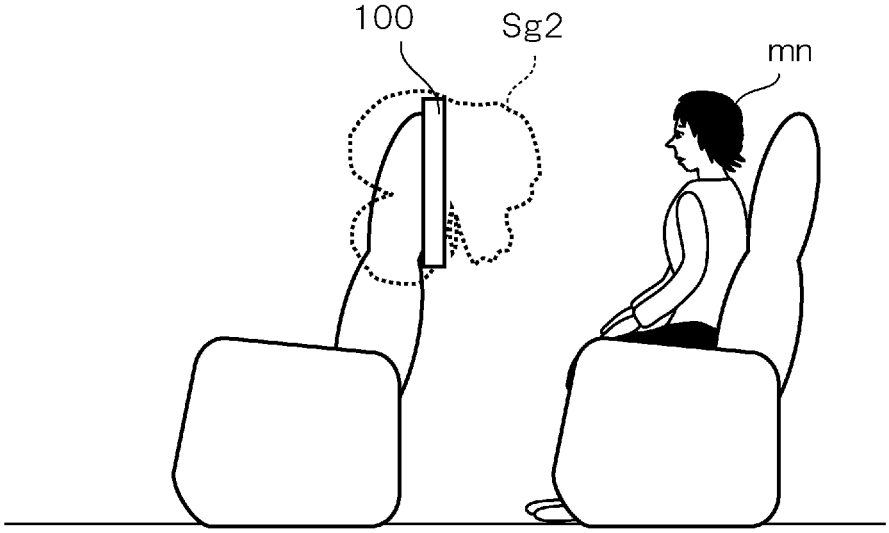
FIG. 10B is a diagram showing a radiation pattern of a conventional patch antenna in the case where it is incorporated in the seat monitor.

FIG. 10B is a diagram showing a radiation pattern of the conventional patch antenna in the case where it is incorporated in the seat monitor 100. Where the conventional patch antenna is incorporated in the seat monitor 100, a wireless signal (radio waves) Sg2 radiated form the seat monitor 100 toward the viewer/listener mn has directivity. For example, where the data server is disposed in a direction corresponding to a node of the directivity, there may occur an event that the seat monitor 100 cannot receive distribution data from the data server.

As described above, the patch antenna 5 according to the first embodiment is equipped with an antenna surface 40 on which the patch 45 (an example of the term "antenna conductor") is provided; the ground surface 10 which is opposed to the antenna surface 40 and on which the ground conductor 15 is provided; and the stub 25 obtained by connecting, in series, the three (plural) transmission lines 27, 28, and 29 in which at least one transmission line 28 is different in line width from the other, two or more transmission lines 27 and 29. The at least one transmission line 28 has the first straight portion 281, the second straight portion 283 and the bent portion 282.

With this configuration, the patch antenna 5 can widen the communication frequency band and increase the antenna gain by decreasing the Q value indicating the sharpness of a peak of a resonance frequency characteristic without increasing the overall thickness of the patch antenna 5 itself. Furthermore, the total area of the power supply surface in which the stub 25 is provided can be made smaller than in a stub that is not formed with a bending portion, whereby the degree of electrical coupling between the antenna surface 40 and the power supply surface 20 is increased and the operative frequency band of the patch antenna 5 can be widened.

In the patch antenna 5, wherein the plurality of transmission lines are the three transmission lines 27, 28, and 29 among which two transmission lines 27 and 29 other than the at least one transmission line 28 have the same line width. With this measure, since the transmission lines 27 and 29 having the same line width can be used as common transmission lines, impedance matching of the patch antenna 5 can be attained more easily without requiring cumbersome work than in a case that the line widths of the plurality of transmission lines constituting the stub 25 are different from each other.

The antenna device 5 is further equipped with the substrate 8 which is made of a dielectric. The substrate 8 is configured by the first substrate 8*a* and the second substrate 8*b* which is provided in a higher layer than the first substrate 8*a*. The ground conductor 15 is provided on the back surface of the first substrate 8*a*. The patch 45 is provided on the front surface of the second substrate 8*b*. The stub 25 is provided between the front surface of the first substrate 8*a* and the back surface of the second substrate 8*b*. With this measure, the radiation reactance component of parallel resonance of the antenna conductor can be cancelled out by influence of the reactance component of the series resonance circuit of the stub 25 through electrical coupling in the top-bottom direction between the antenna surface 40 and the power supply surface 20, whereby the bandwidth and the gain of the patch antenna 5 can be increased.

The bent portion 282 is formed so as to be continuous with the first straight portion 281 and the second straight portion 283 so as to come closer to the power supply point 21 that supplies an excitation signal to the patch antenna 5. With this measure, since the stub 25 comes closer to the power supply point 21 as a whole, the degree of electrical coupling between the antenna surface 40 and the power supply surface 20 can be increased further, whereby the operative frequency band of the patch antenna 5 can be widened further.

The antenna surface 40 is rectangular and further has the cut 45*z* which is formed in one side that is most distant from an imaginary corresponding point (described above) in the patch 45 corresponding to a power supply point 21 that supplies an excitation signal to the patch 45. With this measure, since the cut 45*z* is formed in the one side that is most distant from the power supply point 21, impedance matching adjustment in the patch antenna 5 can be simplified, the reflectance characteristic (e.g., fractional bandwidth) of the VSWR (voltage standing wave ratio) can be improved, whereby the operative frequency band of the patch antenna 5 can be widened further.

The ground surface 10 is approximately rectangular and has the pair of extension portions 15*z* and 15*y* which extend from the two respective ends of one side that is most distant from an imaginary corresponding point (described above) corresponding to the power supply point 21 that supplies an excitation signal to the patch 45 approximately perpendicularly to the one side. With this measure, since the overall circumference (overall length) of the ground conductor provided on the ground surface 10 can be adjusted so as to be longer than the overall circumference (overall length) of the patch 45 provided on the antenna surface 40, occurrence of a direction in which the radiation of radio waves is weak (occurrence of a node in electric field intensity) in a directivity pattern of the patch antenna 5 can be suppressed, which makes it easier to obtain desired directivity.

(Modification 1)

Figure 9B:
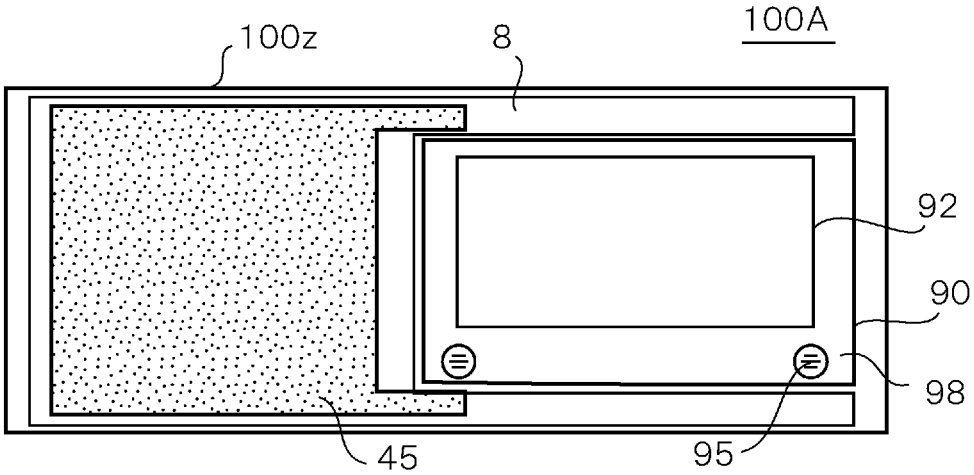
FIG. 9B is a diagram showing an inside layout of a seat monitor incorporating a patch antenna according to Modification 1.

FIG. 9B is a diagram showing the configuration of a seat monitor 100A which incorporates a patch antenna 5 according to Modification 1. Elements having the same ones in the first embodiment will be given the same symbols as the latter and will not be described.

In the seat monitor 100A relating to Modification 1, a board 98A of a rectangular output device 90A is disposed so as to go into the inside of the pair of extension portions 15*z* and 15*y* provided on the substrate 8 of the patch antenna 5 completely. Thus, inside a body 100*z*, the substrate 8 of the patch antenna 5 and the board 98A of the output device 90A can be arranged more densely and hence the external shape of the seat monitor 100A can be made smaller. Furthermore, the external shape of the board 98A can be made rectangle and hence the board 98A is made easier to handle. As a result, the bottom surface, having a limited area, of the body 100*z* of the seat monitor 100A can be utilized effectively.

Embodiment 2

The substrate of a patch antenna according to a second embodiment is thinner than that of the patch antenna according to the first embodiment. The planar shape and structure of the patch antenna are the same as in the first embodiment. In the first embodiment, the thickness of the substrate 8 is 2.6 mm, for example. In the second embodiment, the thickness of the substrate 8 is 2.0 mm. For details, the thickness to of the first substrate 8*a* is 1.8 mm, the thickness tb of the second substrate 8*b* is 0.1 mm, and the thickness of the copper foil is 0.1 mm.

Where the thickness (i.e., the distance from the surface of the patch provided on the antenna surface to the surface of the ground conductor provided on the ground surface) of a patch antenna is small, the interval between the patch and the ground conductor is small and hence it becomes difficult to increase the bandwidth of the patch antenna. That is, it is expected that the characteristics of the patch antenna 5 are lowered.

Figure 11:
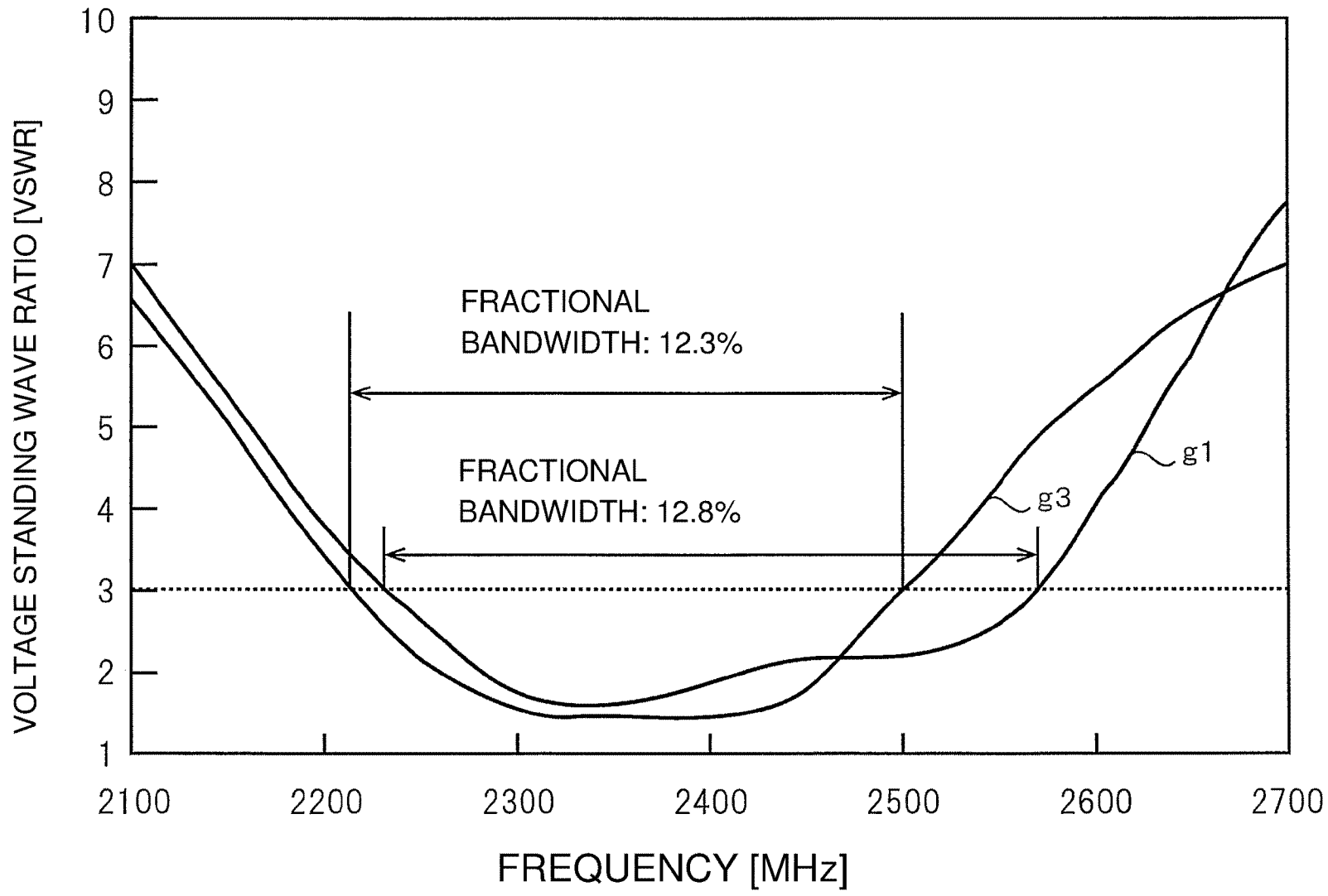
FIG. 11 is a graph showing a voltage standing wave ratio of a patch antenna according to the second embodiment.

FIG. 11 is a graph showing a voltage standing wave ratio (VSWR) of the patch antenna according to the second embodiment. As shown in FIG. 7 as graph g1, the VSWR of the patch antenna having the thickness 2.4 mm has a gentle characteristic in a 2.4-GHz frequency range. The fractional bandwidth is 12.8%. On the other hand, the VSWR of the patch antenna having the thickness 2.0 mm (graph g3) also has a gentle characteristic that is similar to the characteristic of the patch antenna having the thickness 2.4 mm. The fractional bandwidth is equal to 12.3% which is slightly smaller than in the patch antenna having the thickness 2.4 mm. However, this fractional bandwidth value (bandwidth value) is sufficiently larger than 4.1% of the conventional patch antenna.

Figure 12:
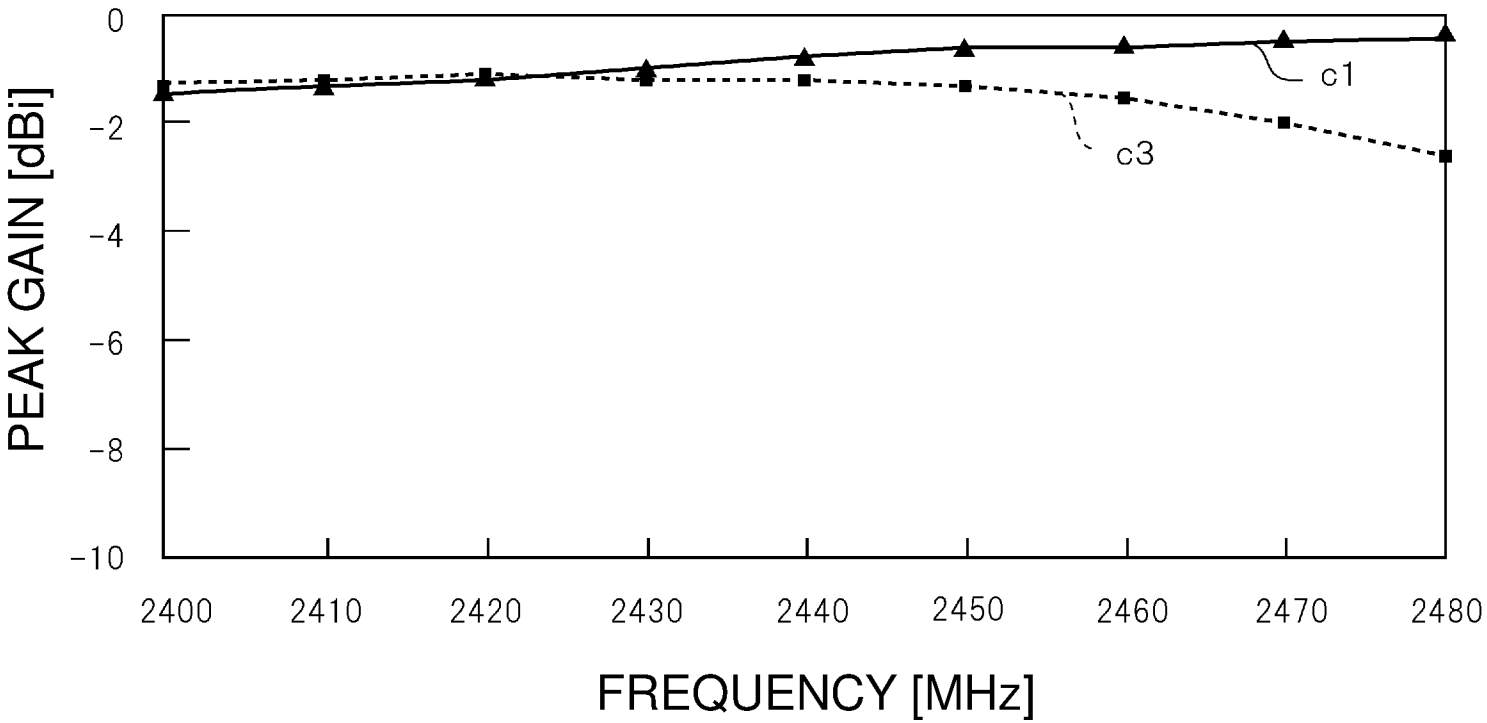
FIG. 12 is a graph showing how the peak gain varies with the frequency.

FIG. 12 is a graph showing how the peak gain varies with the frequency. The patch antenna having the thickness 2.4 mm has a characteristic (graph c1) that the peak gain increases slightly from 2,400 MHz to 2,480 MHz. On the other hand, the patch antenna having the thickness 2.0 mm has a characteristic (graph c3) that the peak gain increases slightly from 2,400 MHz to 2,440 MHz and then decreases gradually as the frequency goes toward 2,480 MHz. Thus, in a frequency range higher than 2,480 MHz, the peak gain of the patch antenna having the thickness 2.0 mm is smaller than that of the patch antenna having the thickness 2.4 mm. As a result, the gain decreases slightly and the transmission efficiency of radio waves lowers in a high frequency range. However, also in the patch antenna having the thickness 2.0 mm, sufficiently usable peak gain values can still be secured from 2,400 MHz to 2,480 MHz.

Figure 13A:
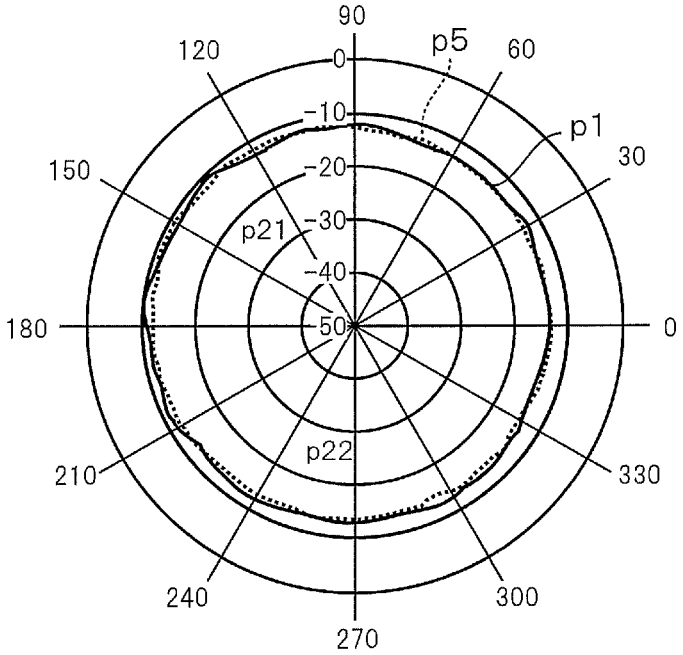
FIG. 13A is a directivity characteristic diagram showing radiation patterns of vertically polarized radio waves.

FIG. 13A is a directivity characteristic diagram showing radiation patterns of vertically polarized radio waves. Comparing a radiation pattern p1 of the patch antenna having the thickness 2.4 mm and a radiation pattern p5 of the patch antenna having the thickness 2.0 mm, one can see that there is almost no differences between these radiation patterns of vertically polarized radio waves.

Figure 13B:
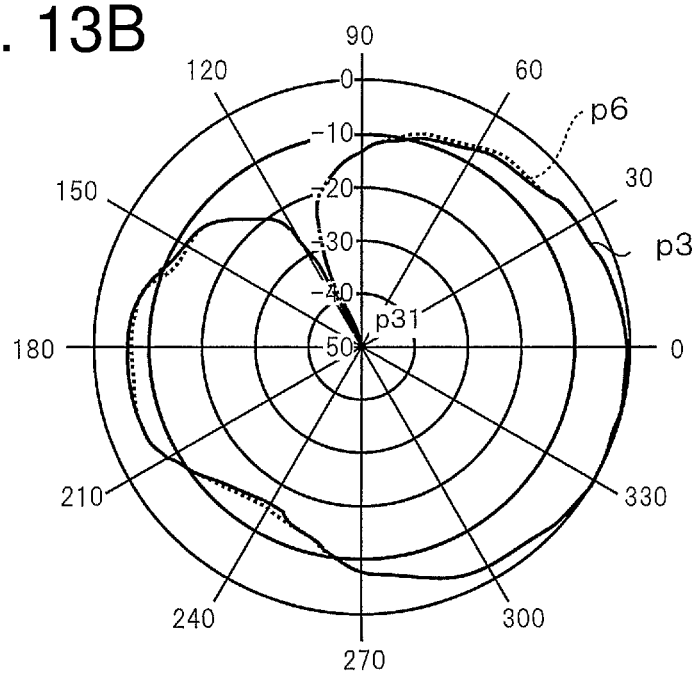
FIG. 13B is a directivity characteristic diagram showing radiation patterns of vertically polarized radio waves.

FIG. 13B is a directivity characteristic diagram showing radiation patterns of vertically polarized radio waves. Comparing a radiation pattern p3 of the patch antenna having the thickness 2.4 mm and a radiation pattern p6 of the patch antenna having the thickness 2.0 mm, one can see that there is almost no differences between the radiation patterns of horizontally polarized radio waves. It is therefore concluded that the patch antenna having the thickness 2.4 mm and the patch antenna having the thickness 2.0 mm have almost the same radiation pattern of radio waves.

As described above, the performance, that is, the voltage standing wave ratio, peak gain, and radiation pattern, of the patch antenna according to the second embodiment has been checked through comparison with the patch antenna according to the first embodiment, to produce the following conclusions. Performance that makes the patch antenna sufficiently usable can be maintained though the performance is degraded a little due to the thickness reduction of the patch antenna. On the other hand, the patch antenna can be miniaturized because of its thickness reduction. That is, the patch antenna according to the second embodiment can accommodate more thickness reduction than the patch antenna according to the first embodiment does while securing the patch antenna performance.

(Modification 2)

Figure 14:
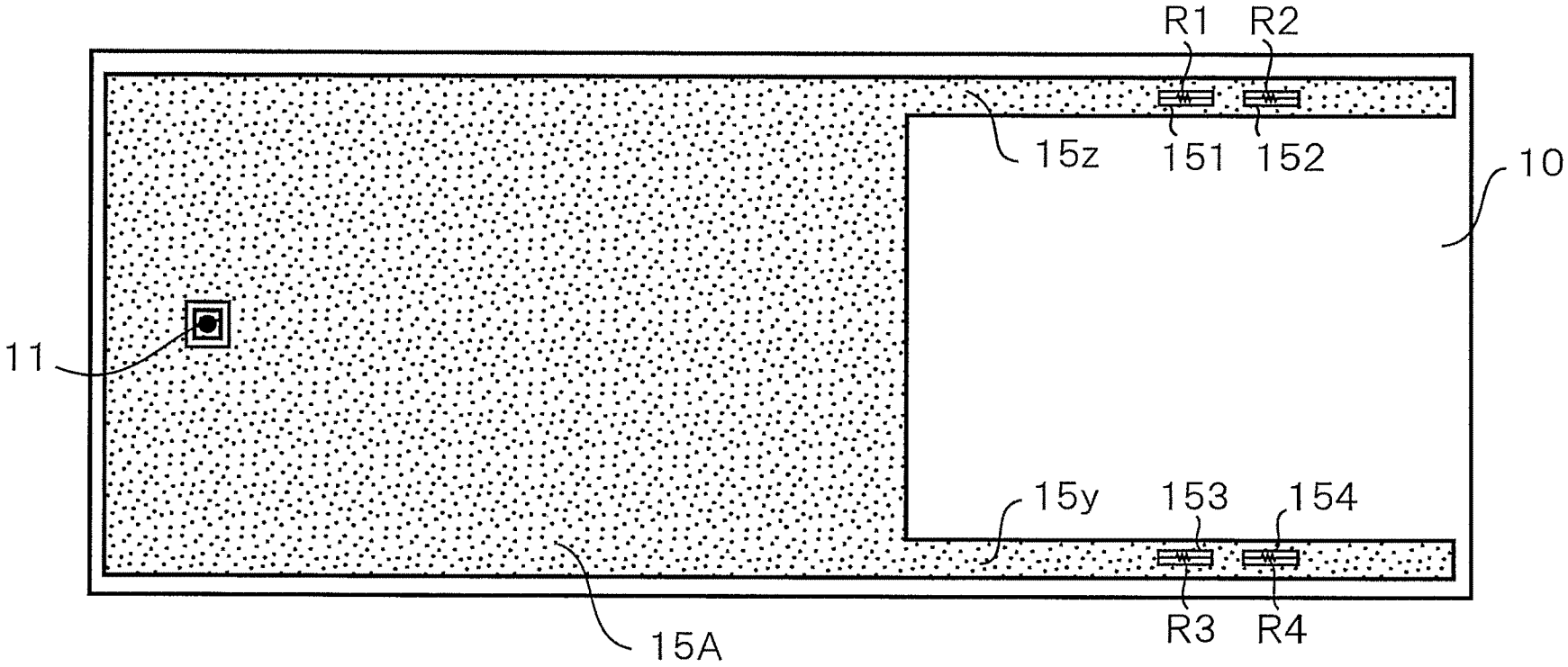
FIG. 14 is a view showing a ground conductor that is provided on a ground surface of a patch antenna according to Modification 2.

FIG. 14 is a view showing a ground conductor 15A that is provided on the ground surface of a patch antenna according to Modification 2. One or plural slits are formed in at least one of a pair of extension portions 15*z* and 15*y* that project from the two respective ends of one side, most distant from a corresponding point on the ground surface 10 (in other words, an imaginary corresponding point on the ground surface 10) obtained by moving the power supply point 21 downward imaginarily, of a ground conductor 15A approximately perpendicularly to the one side. In this example, two slits 151 and 152 are formed in the extension portion 15*z*. A resistor R1 or R2 is connected to the confronting sides of the opening of each of the slits 151 and 152. Likewise, two slits 153 and 154 are formed in the extension portion 15*y*. A resistor R3 or R4 is connected to the confronting sides of the opening of each of the slits 153 and 154.

With this structure, the lengths of the four sides surrounding each of the slits 151 and 152 formed in the extension portion 15*z* can be added to the length of the circumference of the extension portion 15*z*, which makes it easier to attain impedance matching. The same is true of the slits 153 and 154 formed in the extension portion 15*y*. That is, the overall circumferential length of the ground conductor 15 can be increased without increasing the area of the conductor portion of the ground conductor 15. Increase in the circumferential length of the ground conductor 15 makes it easier to attain impedance matching. Thus, the adjustment (increase and decrease) of the gain of the patch antenna can be performed easily.

Although the various embodiments have been described above with reference to the drawings, it goes without saying that the present disclosure is not limited to those examples. It is apparent that those skilled in the art could conceive various changes, modifications, replacements, additions, deletions, or equivalents within the confines of the claims, and they are naturally construed as being included in the technical scope of the disclosure. And constituent elements of the above-described various embodiments may be combined in a desired manner without departing from the spirit and scope of the invention.

Figure 15:
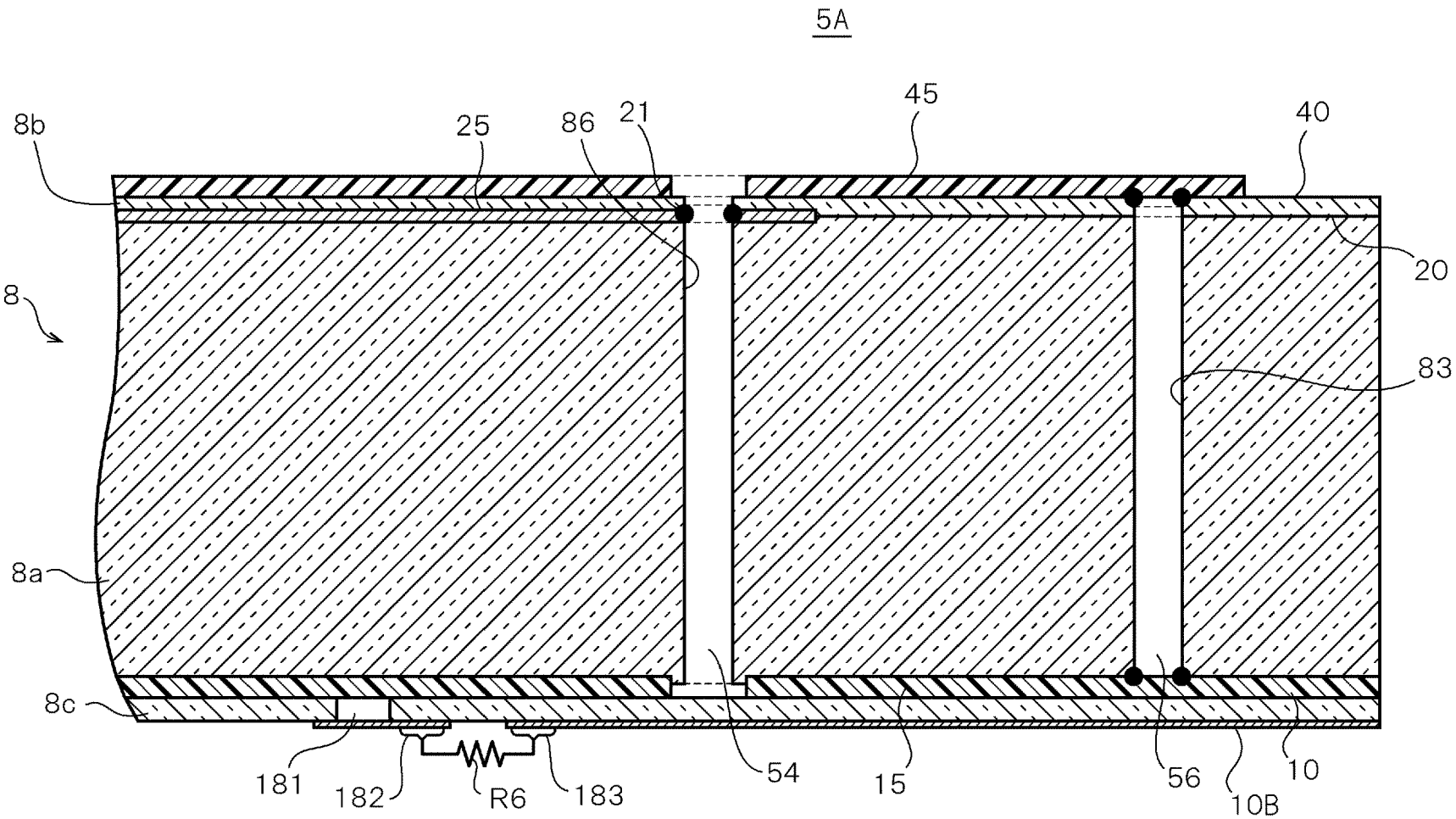
FIG. 15 is a sectional view showing a layered structure of a patch antenna provided in a four-layer substrate.

For example, although in each of the above-described embodiments the substrate in which the patch antenna is provided is a three-layer substrate, it may be a four-layer substrate. FIG. 15 is a sectional view showing a layered structure of a patch antenna 5A formed in a four-layer substrate. In the four-layer substrate, a third substrate 8*c* is laid on (under) the first substrate 8*a*. Thus, a ground surface 10B in the lowest layer is provided on the back surface of the substrate 8*c* which is provided under the ground surface 10. Two lands 182 and 183 which are connected to each other by a resistor R6 are provided on the ground surface 10B in the lowest layer. The land 183 is electrically connected to a ground conductor (not shown) that is provided on the ground surface 10B in the lowest layer. The land 182 is electrically connected to the ground conductor 15 which is provided on the ground surface 10 via a conductor 181. In this manner, the ground conductor provided on the ground surface 10B in the lowest layer is electrically connected to the ground conductor 15 provided on the ground surface 10, whereby the total length of the overall circumferences of the ground conductors can be increased. This makes it easier to attain impedance matching.

It is noted that each of the above-described patch antennas can be used as both of an antenna of a transmission device for transmitting radio waves and an antenna of a receiving device for receiving radio waves.

The present application is based on Japanese Patent Application No. 2018-018679 filed on Feb. 5, 2018, the disclosure of which is invoked herein by reference.

The present disclosure is useful when employed in antenna devices capable of widening the communication frequency band and increasing the antenna gain by decreasing the Q value indicating the sharpness of a peak of a resonance frequency characteristic without increasing the overall thickness of the antenna device itself

What is claimed is:

1. An antenna device comprising:

an antenna surface on which an antenna conductor is provided;

a ground surface which is opposed to the antenna surface and on which a ground conductor is provided; and a stub configured by connecting, in series, a plurality of transmission lines in which a line width of at least a part of at least one transmission line is different from line widths of other two or more transmission lines, wherein:

the at least one transmission line has a first straight portion, a second straight portion, and a bent portion;

the stub is located so as to be closer to a first side of the antenna surface than a second side of the antenna surface; and one of the plurality of transmission lines has a start point as a power supply point, an end point connected to another transmission line, and a plurality of bending portions.

2. The antenna device according to claim 1, wherein the plurality of transmission lines are three transmission lines among which two transmission lines other than the at least one transmission line have the same line width.

3. The antenna device according to claim 1, further comprising:

a substrate which is made of a dielectric, wherein:

the substrate has a first substrate and a second substrate which is provided in a higher layer than the first substrate;

the ground conductor is provided on a back surface of the first substrate;

the antenna conductor is provided on a front surface of the second substrate; and the stub is provided between a front surface of the first substrate and a back surface of the second substrate.

4. The antenna device according to claim 1, wherein the bent portion is formed so that (i) a first end of the bent portion is continuous with the first straight portion, (ii) a second end of the bent portion is continuous with the second straight portion, and the second end of the bent portion is closer to a power supply point which supplies an excitation signal to the antenna conductor than the first end of the bent portion.

5. The antenna device according to claim 1, wherein the antenna surface has a rectangular shape and further has a cut which is formed in one side of the rectangular shape that is most distant of all of the sides of the rectangular shape from an imaginary corresponding point corresponding to a power supply point which supplies an excitation signal to the antenna conductor.

6. The antenna device according to claim 1, wherein the ground surface has a approximately rectangular shape and has a pair of extension portions that extend from both ends of one side of the rectangular shape that is most distant of all of the sides of the rectangular shape from an imaginary corresponding point corresponding to a power supply point which supplies an excitation signal to the antenna conductor approximately perpendicularly to the one side.

7. The antenna device according to claim 6, wherein:

a slit is formed in each of the pair of extension portions; and portions around the slit of each of the pair of extension portions is connected by a resistor.

* * * * *